US008038404B2

(12) United States Patent
Mujezinovic et al.

(10) Patent No.: US 8,038,404 B2
(45) Date of Patent: Oct. 18, 2011

(54) STEAM TURBINE AND ROTATING BLADE

(75) Inventors: Amir Mujezinovic, Schenectady, NY (US); Steven DeLessio, Saratoga Springs, NY (US)

(73) Assignee: Nuovo Pignone Holdings, S.p.A., Florence (IT)

( * ) Notice: Subject to any disclaimer, the term of this patent is extended or adjusted under 35 U.S.C. 154(b) by 1124 days.

(21) Appl. No.: 11/778,184

(22) Filed: Jul. 16, 2007

(65) Prior Publication Data

US 2009/0022591 A1 Jan. 22, 2009

(51) Int. Cl.
*F01D 5/30* (2006.01)

(52) U.S. Cl. ..... 416/219 R; 416/248

(58) Field of Classification Search ..... 416/215, 416/216, 217, 218, 219 R, 220 R, 221, 248
See application file for complete search history.

(56) References Cited

U.S. PATENT DOCUMENTS

| | | | | |
|---|---|---|---|---|
| 2,753,149 | A * | 7/1956 | Kurti | 416/216 |
| 4,191,509 | A * | 3/1980 | Leonardi | 416/219 R |
| 4,692,976 | A * | 9/1987 | Andrews | 29/889.7 |
| 4,824,328 | A * | 4/1989 | Pisz et al. | 416/219 R |
| 5,147,180 | A * | 9/1992 | Johnson | 416/219 R |
| 5,176,500 | A * | 1/1993 | Heinig | 416/219 R |
| 5,480,285 | A | 1/1996 | Patel et al. | |
| 5,554,005 | A * | 9/1996 | Nguyen | 416/219 R |
| 6,575,700 | B2 | 6/2003 | Arai et al. | |
| 7,794,208 | B2 * | 9/2010 | Suzuki et al. | 416/219 R |

* cited by examiner

*Primary Examiner* — Igor Kershteyn
(74) *Attorney, Agent, or Firm* — Nixon & Vanderhye P.C.

(57) ABSTRACT

A blade mountable to a disc comprises a blade platform and a blade root extending from the blade platform. The blade root comprises first, second, and third hooks and first, second and third necks. Each hook comprises a contact surface and a non-contact surface, and an angle between each contact surface and each non-contact surface is optimized to reduce local and average stresses.

16 Claims, 4 Drawing Sheets

STEAM TURBINE AND ROTATING BLADE

BACKGROUND OF THE INVENTION

The present invention relates to a rotating blade and rotor for a steam turbine and, more particularly, to an attachment arrangement for attaching a blade of a steam turbine to a rotor that minimizes local and average stresses.

The steam flow path of a steam turbine is formed by a stationary cylinder and a rotor. A number of stationary vanes are attached to the cylinder in a circumferential array and extend inward into the steam flow path. Similarly, a number of rotating blades are attached to the rotor in a circumferential array and extend outward into the steam flow path. The stationary vanes and rotating blades are arranged in alternating rows so that a row of vanes and the immediately downstream row of blades form a stage. The vanes serve to direct the flow of steam so that it enters the downstream row of blades at the correct angle. The blade airfoils extract energy from the steam, thereby developing the power necessary to drive the rotor and the load attached to it.

The blade airfoils extend from a blade root used to secure the blade to the rotor disc. Conventionally, this is accomplished by imparting a fir tree shape to the root by forming approximately axially extending alternating tangs and grooves along the sides of the blade root. Slots having mating tangs and grooves are formed in the rotor disc. When the blade root is slid into the disc slot, the centrifugal load on the blade, which is very high due to the high rotational speed of the rotor—typically 3600 rpm for a steam turbine employed in electrical power generation, is distributed along portions of the tangs over which the root and disc are in contact. Because of the high centrifugal loading, the stresses in the blade root and disc slot are very high. It is desirable, therefore, to minimize the stress concentrations formed by the tangs and grooves and maximize the bearing areas over which the contact forces between the blade root and disc slot occur. This is especially desirable in the latter rows of a low pressure steam turbine due to the large size and weight of the blades in these rows and the presence of stress corrosion due to moisture in the steam flow. The latter stages experience higher local stresses that may lead to lower fatigue life of the rotor and the rotating blades. There is also an increasing demand for longer rotating blades, which requires the rotor and blades to operate under even higher loads.

In addition to the steady centrifugal loading, the blades are also subject to vibration.

It is therefore desirable to provide a rotor and blade attachment configuration that has centrifugal load carrying capability, reduced local stresses on the rotor (wheel) and the fillets of the rotating blades, while maintaining average and shear stresses low.

BRIEF DESCRIPTION OF THE INVENTION

In one embodiment of the invention, a blade mountable to a disc comprises a blade platform and a blade root extending from the blade platform. The blade root comprises first, second, and third hooks and first, second and third necks. Each hook comprises a contact surface and a non-contact surface, and an angle between each contact surface and each non-contact surface is optimized to reduce local and average stresses.

In another embodiment of the invention, a blade mountable to a disc comprises a blade platform and a blade root extending from the blade platform. The blade root comprises first, second, and third hooks and first, second and third necks. Each hook comprises a contact surface and a non-contact surface, and an angle between each contact surface and each non-contact surface is about 70.6°.

In a further embodiment of the invention, a turbine comprises a blade root extending from the blade platform. The blade root comprises first, second, and third blade hooks and first, second and third blade necks. Each blade hook comprises a contact surface and a non-contact surface, and an angle between each contact surface and each non-contact surface. The turbine further comprises a rotor disc comprising a slot. The slot comprises first, second and third rotor hooks and first, second and third rotor necks. Each rotor hook comprises a contact surface in contact with a corresponding contact surface of the blade and a non-contact surface spaced from a corresponding non-contact surface of the blade. The rotor contact surfaces are angled from the rotor non-contact surface at the same angle as the angle between the blade contact surfaces and the blade non-contact surfaces. The angle is optimized to reduce local and average stresses between the contact surfaces.

DETAILED DESCRIPTION OF THE INVENTION

Figure 1:
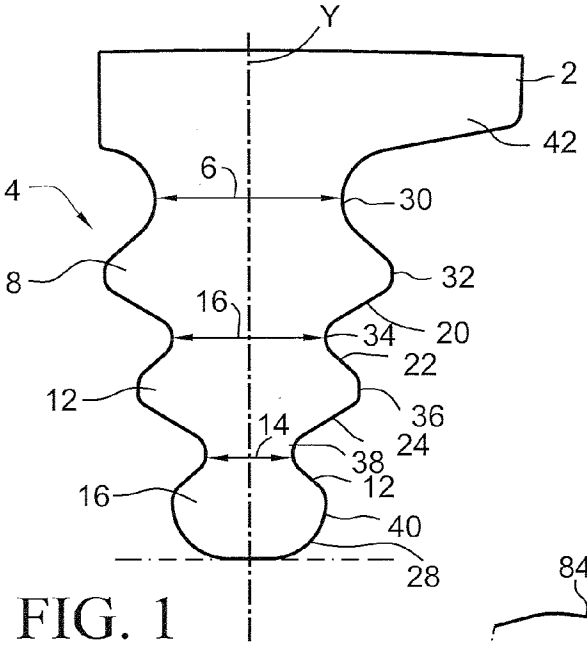
FIG. 1 is a side view of a steam turbine rotating blade including a blade root.

Referring to FIG. 1, a steam turbine rotating blade 2 includes a blade root 4. The blade root 4 may also be referred to as a male dovetail or a bucket dovetail. The bucket dovetail 4 is symmetrical about a dovetail centerline Y. The bucket dovetail 4 comprises a top dovetail neck 6, a top hook 8, a middle dovetail neck 10, a middle hook 12, a bottom dovetail neck 14, and a bottom hook 16. The necks may also be referred to as grooves and the hooks may also be referred to as tangs.

The top hook 8 includes a top slanted contact, or crush, surface 18. The top hook 8 also comprises a top non-contact surface 20. The middle hook 12 comprises a middle slanted contact, or crush, surface 22 and a middle non-contact surface 24. The bottom hook 16 comprises a bottom slanted contact, or crush, surface 26 and a bottom non-contact surface 28.

Figure 2:
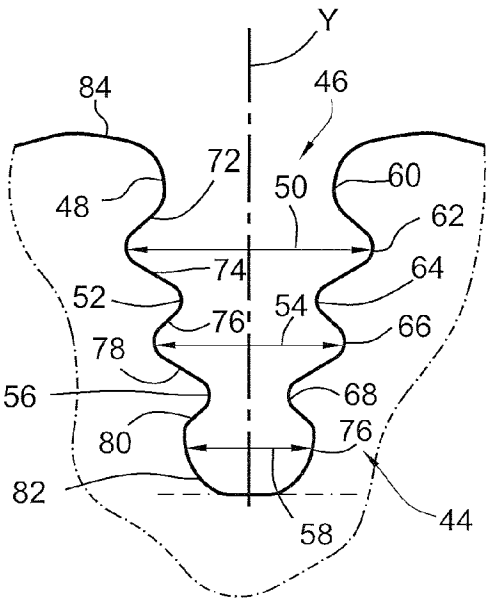
FIG. 2 is a side view of a rotor of the steam turbine including a slot for the blade root.

As shown in FIG. 2, the rotor disc 44 comprises a slot, or rotor dovetail 46. The rotor dovetail 46 may also be referred to as a female dovetail or a wheel dovetail. The rotor dovetail 46 is also symmetric about the dovetail centerline Y. The rotor dovetail 46 comprises a top hook 48, a top neck 50, a middle hook 52, a middle neck 54, a bottom hook 56, and a bottom neck 58.

The top hook 48 comprises a top slanted, or crush, surface 72 and a top non-contact surface 74. The middle hook 52 comprises a middle slanted contact, or crush, surface 76 and a middle non-contact surface 78. The bottom hook 56 comprises a bottom slanted contact, or crush, surface 80 and a bottom non-contact surface 82.

Figure 3:
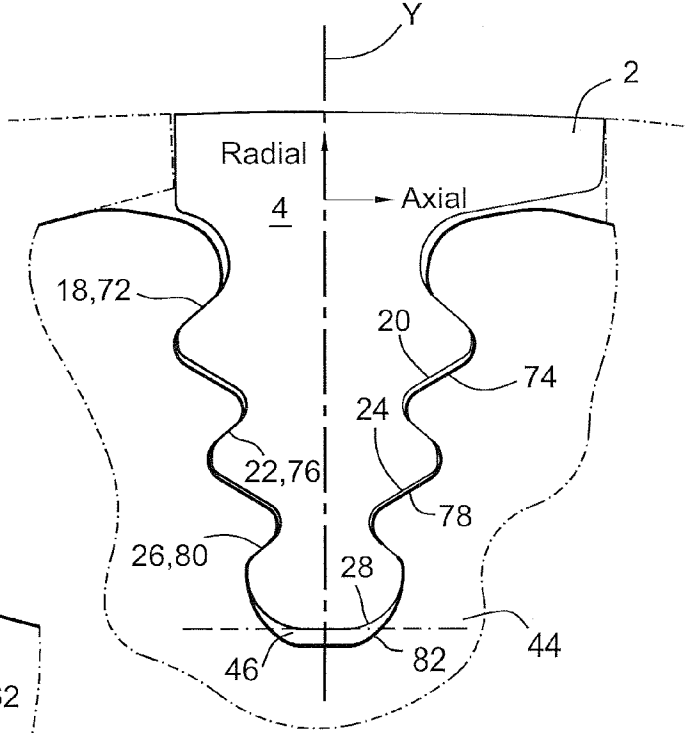
FIG. 3 is a side view of the assembled blade and rotor.

Referring to FIG. 3, the bucket dovetail 4 is assembled to the rotor disc 44 by sliding the bucket dovetail 4 into the rotor dovetail 46 in an axial direction, i.e., in a direction perpendicular to the dovetail centerline Y into the plane of the drawing figure. In the assembled condition shown in FIG. 3, the top slanted crush surface 18 of the bucket dovetail 4 contacts the top slanted crush surface 72 of the rotor dovetail 46. The middle slanted crush surface 22 of the bucket dovetail 4 contacts the middle slanted crush surface 76 of the rotor dovetail 46. The bottom slanted crush surface 26 of the bucket dovetail 4 contacts the bottom slanted crush surface 80 of the rotor dovetail 46. As also shown in FIG. 3, the non-contact surfaces 20, 24, 28 of the bucket dovetail 4 oppose, but do not contact, the non-contact surfaces 74, 78, 82, respectively, of the rotor dovetail 46.

Figure 4:
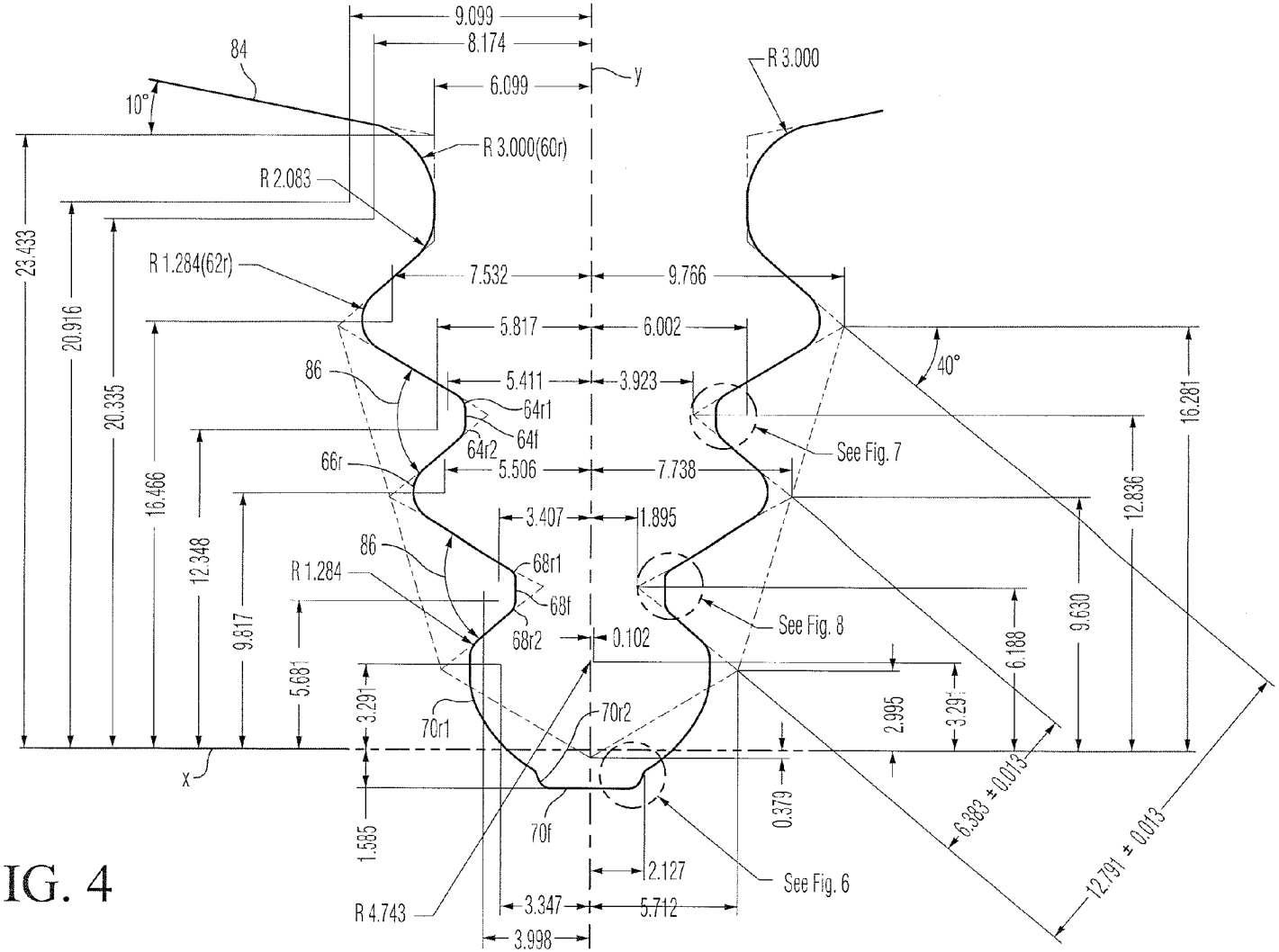
FIG. 4 is a detailed side view of the rotor, including the slot.
Figure 5:
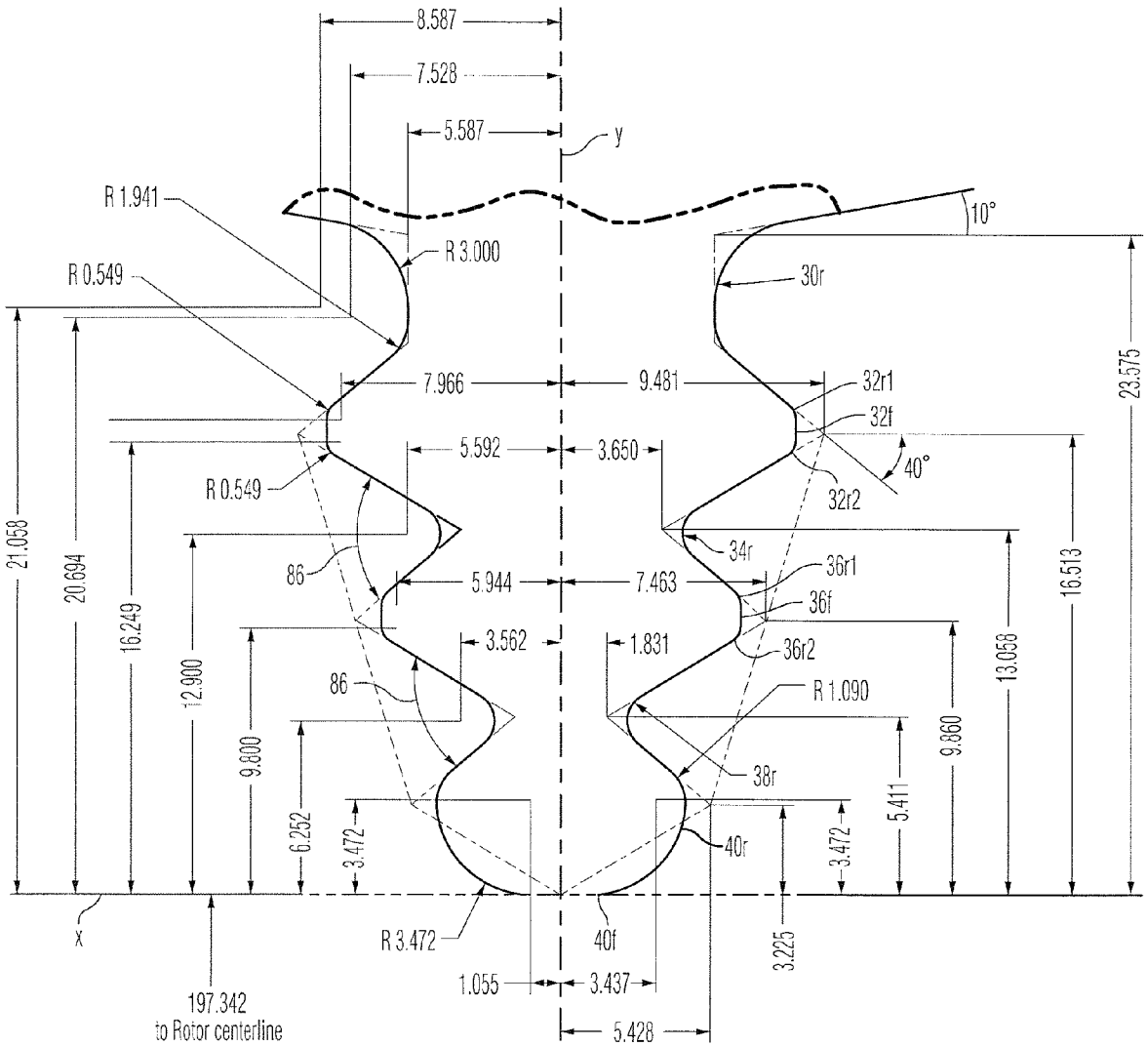
FIG. 5 is a detailed side view of the blade, including the blade root.
Figure 6:
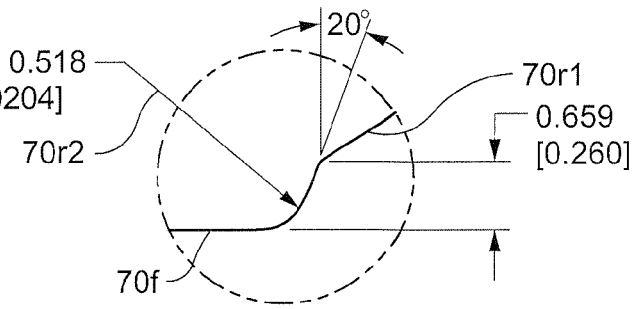
FIG. 6 shows Detail D-4 of FIG. 4.

Referring to FIGS. 4 and 5, a slant angle 86 is provided between the top non-contact surface 20 and the middle slanted crush surface 22 of the bucket dovetail 4. The slant angle 86 is also provided between the middle non-contact surface 24 and the bottom slanted crush surface 26. Similarly, in the rotor dovetail 46 shown in FIG. 4, the slant angle 86 is provided between the top non-contact surface 74 and the middle slanted crush surface 76. The slant angle 86 is also provided between the middle non-contact surface 78 and the bottom slanted crush surface 80 of the rotor dovetail 46.

The crush surfaces are rotated, or oriented, such that the transition angle between the crush surfaces and the non-contact surfaces is about 70.6°. The slant angle is generally substantially symmetrical about the axis X. Concentrated stresses result when load paths are forced to change direction. By providing the slanted crush surfaces, the change in direction is less severe and the stress concentration is lower. The slanted crush surfaces also permit a larger fillet radius in the transition distance. The larger fillet radius also results in a lower concentrated stress, while increasing the crush contact area.

Referring to FIGS. 1 and 5, the top dovetail neck 6 comprises a top neck fillet 30, the middle dovetail neck 10 comprises a middle neck fillet 34, and the bottom dovetail neck 14 comprises a bottom neck fillet 38. The slant angle 86 between the hooks 8, 12, 16 allows a larger neck fillet radius, which results in a reduction of local stresses in the bucket dovetail 4. The radii 34*r*, 38*r* of the middle neck fillet 34 and the bottom neck fillet 38, respectively, are equal. The radius 30*r* of the top neck fillet 30 is larger than the radii 34*r*, 38*r* to allow a smooth transition with the bucket dovetail platform 42. The radii 30*r*, 34*r*, 38*r* are optimized to reduce local stress concentration.

The top hook 8 of the bucket dovetail 4 comprises a top hook fillet 32. The top hook fillet 32 comprises two radii 32*r*1, 32*r*2 and a flat surface 32*f*. The middle hook 12 of the bucket dovetail 4 also comprises a middle hook fillet 36 that comprises a first radius 36*r*1 a second radius 36*r*2 joined by a flat surface 36*f*. The bottom hook 16 of the bucket dovetail 4 comprises a bottom hook fillet 40 that comprises a compound radius 40*r* ending with a flat 40*f* at the bottom of the bucket dovetail 4.

Referring to FIGS. 2, 4 and 6-8, the top neck 50 of the rotor dovetail 46 comprises a top neck fillet 62 and the middle neck 54 comprises a middle neck fillet 66. The top neck fillet comprises a single radius 62*r* and the middle neck fillet 66 comprises a single radius 66*r*. The radii 62*r* and 66*r* are equal. The bottom neck 58 of the rotor dovetail 46 comprises a bottom neck fillet 70 that comprises a compound radius 70*r*1, 70*r*2 that is selected to blend smoothly towards the bottom 70*f* of the rotor dovetail 46.

Figure 7:
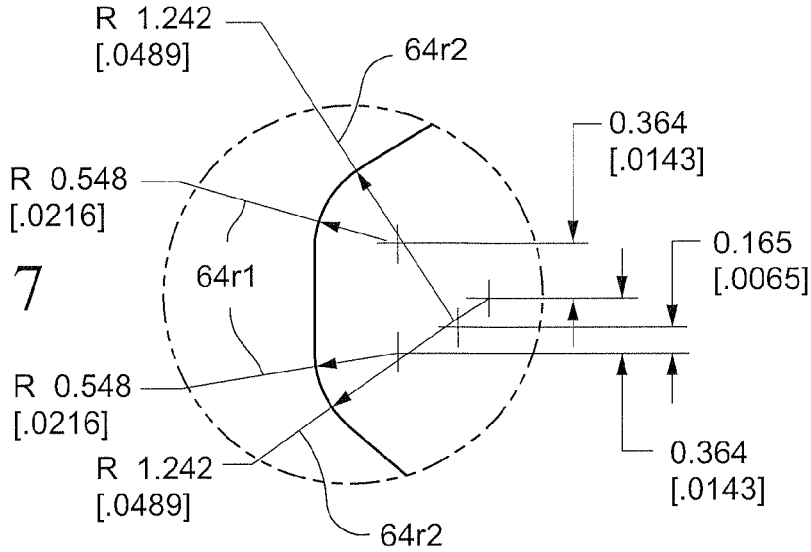
FIG. 7 shows Detail C-3 of FIG. 4.

The top hook 48 of the rotor dovetail 46 comprises a top hook fillet 60. The top hook fillet 60 comprises a single radius 60*r*. The middle hook 52 comprises a middle hook fillet 64 and the bottom hook 56 comprises a bottom hook fillet 68. The middle hook fillet 64 comprises two radii 64*r*1, 64*r*2. As shown in FIG. 7, the first radius 64*r*1 is smaller than the second radius 64*r*2. The middle hook fillet 64 also comprises a flat surface 64*f*.

Figure 8:
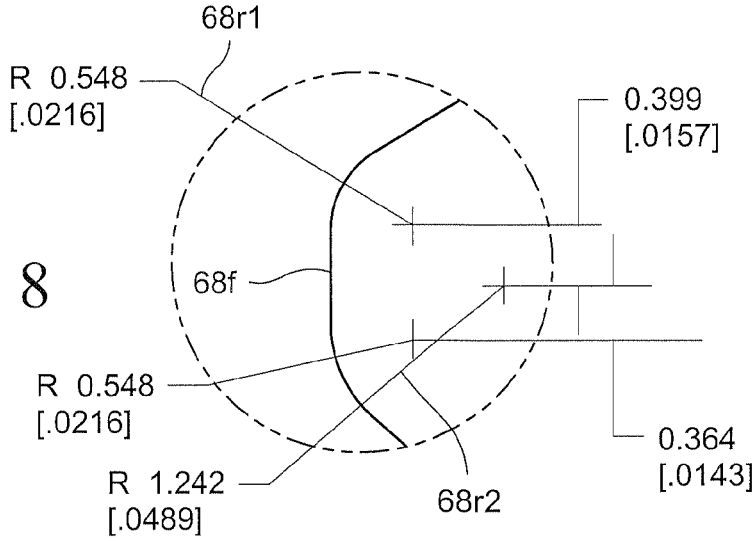
FIG. 8 shows Detail C-1 of FIG. 4.

As shown in FIG. 8, the bottom hook fillet 68 comprises two radii 68*r*1, 68*r*2. The first radius 68*r*1 is smaller than the second radius 68*r*2. The bottom hook fillet 68 also comprises a flat surface 68*f*.

The top hook fillet 60, on one hand, and the middle and bottom hook fillets 64 and 68, on the other hand, are different and optimized to carry loads equally. The top hook fillet 60 has a larger radius 60*r* than the middle hook fillet 64 and the bottom hook fillet 68 to provide a smooth transition with the top rotor surface 84.

The hook thickness and neck length controls the load sharing between hooks as well as the bending and shear stiffness/stresses in the hook. All of this contributes to the degree of concentrated stress and strain. The hook thickness and neck length are optimized to minimize local and average stresses. As shown in the drawing figures, the hook thickness is the difference between the dimensions from the X axis along the dovetail centerline Y. For example, the top hook 8 has a thickness of 20.694−12.90=7.794.

As described herein, the location of the radii, the values of the radii, and the other aspects of the shape of the bucket dovetail and rotor dovetail, including, but not limited to, the hook thicknesses and neck lengths, are optimized to minimize the local and average stresses. As shown in the drawing figures, the values of the location of the radii, the values of the radii, the hook thicknesses and neck lengths are shown in millimeters, and the corresponding dimensions in inches are shown in square brackets. However, it should be appreciated that the bucket dovetail and rotor dovetail may be scaled to greater or lesser sizes provided that the shapes remain the same. The values shown in the drawing figures may thus be considered non-dimensional.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A blade mountable to a disc, the blade comprising:

a blade platform; and a blade root extending from the blade platform, the blade root comprising first, second, and third hooks and first, second and third necks, wherein each hook comprises a contact surface and a non-contact surface, and an angle between the non-contact surface of the first hook and the contact surface of the second hook and between the non-contact surface of the second hook and the contact surface of the third hook is optimized to reduce local and average stresses and the angle is substantially symmetrical about an axis perpendicular to a centerline of the blade root.

2. A blade according to claim 1, wherein each of the first and second hooks comprise fillets, each fillet comprises a first radius and a second radius, and the fillets are joined by a flat surface.

3. A blade according to claim 2, wherein the second radius is larger than the first radius.

4. A blade according to claim 1, wherein the third hook comprises a first radius and a second radius, and the second radius transitions to a flat bottom of the blade root.

5. A blade according to claim 1, wherein at least one of thicknesses of the hooks and lengths of the necks is optimized to minimize the local and average stresses.

6. A blade mountable to a disc, the blade comprising:

a blade platform; and a blade root extending from the blade platform, the blade root comprising first, second, and third hooks and first, second and third necks, wherein each hook comprises a contact surface and a non-contact surface, and an angle between the non-contact surface of the first hook and the contact surface of the second hook and between the non-contact surface of the second hook and the contact surface of the third hook is about 70.6° and the angle is substantially symmetrical about an axis perpendicular to a centerline of the blade root.

7. A blade according to claim 6, wherein each of the first and second hooks comprise fillets, each fillet comprises a first radius and a second radius, and the fillets are joined by a flat surface.

8. A blade according to claim 7, wherein the second radius is larger than the first radius.

9. A blade according to claim 6, wherein the third hook comprises a first radius and a second radius, and the second radius transitions to a flat bottom of the blade root.

10. A blade according to claim 6, wherein at least one of thicknesses of the hooks and lengths of the necks is optimized to minimize the local and average stresses.

11. A turbine, comprising:

a blade comprising a blade root extending from a blade platform, the blade root comprising first, second, and third blade hooks and first, second and third blade necks, wherein each blade hook comprises a contact surface and a non-contact surface, and an angle between each contact surface of one hook and each non-contact surface of the next hook;

a rotor disc comprising a slot, the slot comprising first, second and third rotor hooks and first, second and third rotor necks, wherein each rotor hook comprises a contact surface in contact with a corresponding contact surface of the blade and a non-contact surface spaced from a corresponding non-contact surface of the blade, wherein the rotor contact surfaces are angled from the rotor non-contact surfaces at the same angle as the angle between the blade contact surfaces and the blade non-contact surfaces, and the angle is optimized to reduce local and average stresses between the contact surfaces and the angle is substantially symmetrical about an axis perpendicular to a centerline of the blade root.

12. A turbine according to claim 11, wherein the first rotor hook comprises a radius that transitions to a top surface of the rotor disc.

13. A turbine according to claim 11, wherein the second rotor and third rotor hooks each comprise fillets, each fillet comprising a first radius and a second radius, and the fillets are joined by a flat surface.

14. A turbine according to claim 13, wherein the first radius is larger than the second radius.

15. A turbine according to claim 11, wherein at least one of thicknesses of the blade hooks and rotor hooks and lengths of the blade necks and rotor necks are optimized to reduce the local and average stresses at the contact surfaces.

16. A turbine according to claim 11, wherein the angle is about 70.6°.

* * * * *